US010481541B2

(12) United States Patent
Hiroe et al.

(10) Patent No.: US 10,481,541 B2
(45) Date of Patent: Nov. 19, 2019

(54) IMAGE FORMING APPARATUS

(71) Applicant: FUJI XEROX CO., LTD., Tokyo (JP)

(72) Inventors: Nobuhiro Hiroe, Kanagawa (JP); Tomoya Saeki, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 92 days.

(21) Appl. No.: 15/497,364

(22) Filed: Apr. 26, 2017

(65) Prior Publication Data

US 2018/0101118 A1 Apr. 12, 2018

(30) Foreign Application Priority Data

Oct. 7, 2016 (JP) ..... 2016-198722

(51) Int. Cl.
*G03G 15/00* (2006.01)

(52) U.S. Cl.
CPC ..... *G03G 15/652* (2013.01); *G03G 15/5029* (2013.01); *G03G 15/657* (2013.01); *G03G 2215/00949* (2013.01); *G03G 2215/2045* (2013.01)

(58) Field of Classification Search
CPC . G03G 2215/2045; G03G 2215/00949; G03G 15/5029; G03G 15/657; G03G 15/652
See application file for complete search history.

(56) References Cited

U.S. PATENT DOCUMENTS

2010/0108733 A1* 5/2010 Fuwa ..... B65H 23/042 226/1
2010/0202818 A1* 8/2010 Fuchs ..... B65H 20/32 400/619
2010/0266304 A1* 10/2010 Inoue ..... G03G 15/657 399/68
2013/0214023 A1* 8/2013 de Jong ..... B41J 11/42 226/1
2013/0299623 A1* 11/2013 Dollevoet ..... B65H 29/243 242/534
2014/0348527 A1* 11/2014 Murakami ..... G03G 15/2028 399/67

(Continued)

FOREIGN PATENT DOCUMENTS

JP 2007-55791 A 3/2007
JP 2010-222118 A 10/2010

*Primary Examiner* — David H Banh
(74) *Attorney, Agent, or Firm* — Sughrue Mion, PLLC

(57) ABSTRACT

An image forming apparatus includes a supplying unit that supplies a continuous recording material, an image forming unit that forms an image on the recording material supplied from the supplying unit, a fixing unit that fixes the image formed on the recording material by the image forming unit, a collecting unit that collects the recording material having passed through the fixing unit, a detecting device that detects a change in tension of the recording material running between the image forming unit and the fixing unit, and a tension adjusting device that adjusts the tension acting on the recording material such that the change in the tension of the recording material falls within a permissible range if the change in the tension of the recording material that is detected by the detecting device exceeds the predetermined permissible range.

10 Claims, 12 Drawing Sheets

(56) References Cited

U.S. PATENT DOCUMENTS

| | | | | |
|---|---|---|---|---|
| 2015/0072330 | A1* | 3/2015 | Rosenberg | G09B 5/02 434/319 |
| 2016/0089872 | A1* | 3/2016 | Jang | B65H 20/02 101/492 |
| 2016/0340140 | A1* | 11/2016 | Onodera | B65H 23/1806 |

* cited by examiner

| SENSOR 1 | SENSOR 2 | DEGREE OF STRETCHING OF CONTINUOUS PAPER | SPEED OF TRANSPORT |
|---|---|---|---|
| ON | ON | NORMAL | NORMAL |
| ON | OFF | LOOSE | INCREASED |
| OFF | ON | TIGHT | REDUCED |

IMAGE FORMING APPARATUS

CROSS-REFERENCE TO RELATED APPLICATIONS

This application is based on and claims priority under 35 USC 119 from Japanese Patent Application No. 2016-198722 filed Oct. 7, 2016.

BACKGROUND

Technical Field

The present invention relates to an image forming apparatus.

SUMMARY

According to an aspect of the invention, there is provided an image forming apparatus including a supplying unit that supplies a continuous recording material, an image forming unit that forms an image on the recording material supplied from the supplying unit, a fixing unit that fixes the image formed on the recording material by the image forming unit, a collecting unit that collects the recording material having passed through the fixing unit, a detecting device that detects a change in tension of the recording material running between the image forming unit and the fixing unit, and a tension adjusting device that adjusts the tension acting on the recording material such that the change in the tension of the recording material falls within a permissible range if the change in the tension of the recording material that is detected by the detecting device exceeds the predetermined permissible range.

BRIEF DESCRIPTION OF THE DRAWINGS

Exemplary embodiments of the present invention will be described in detail based on the following figures, wherein.

DETAILED DESCRIPTION

General Embodiment

Figure 1:
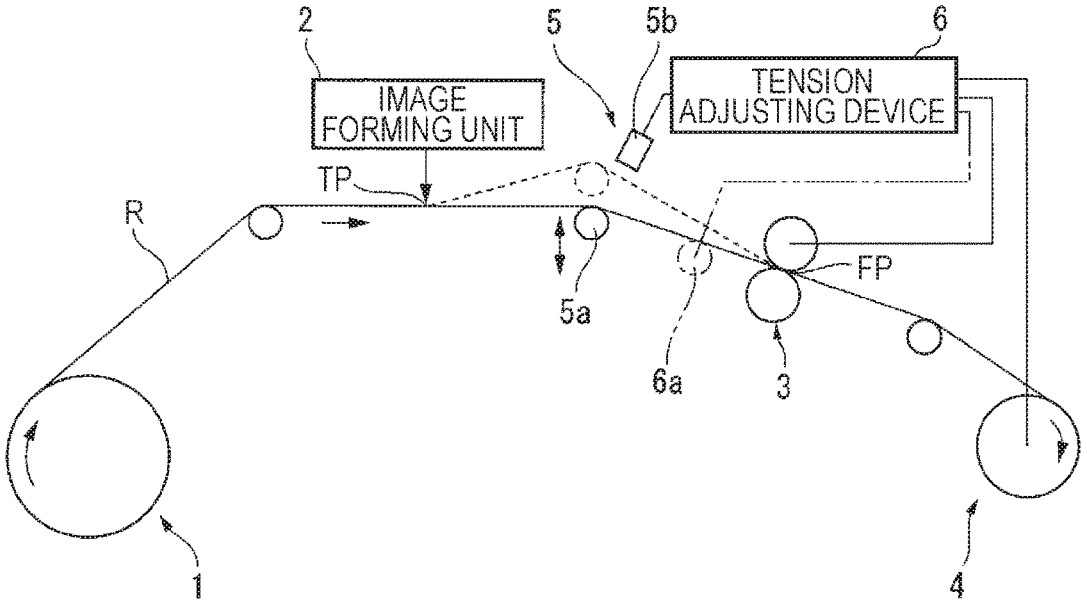
FIG. 1 outlines an image forming apparatus according to a general embodiment of the present invention.

FIG. 1 outlines an image forming apparatus according to a general embodiment of the present invention. As illustrated in FIG. 1, the image forming apparatus includes a supplying unit 1 that supplies a continuous recording material R, an image forming unit 2 that forms an image on the recording material R supplied from the supplying unit 1, a fixing unit 3 that fixes the image formed on the recording material R by the image forming unit 2, a collecting unit 4 that collects the recording material R that has passed through the fixing unit 3, a detecting device 5 that detects a change in the tension of the recording material R running between the image forming unit 2 and the fixing unit 3, and a tension adjusting device 6 that adjusts, if the change in the tension of the recording material R that is detected by the detecting device 5 exceeds a predetermined permissible range, the tension of the recording material R such that the change in the tension falls within the permissible range.

The continuous recording material R may be either a rolled recording material or a folded recording material. The method of transporting the continuous recording material R is not specifically limited. The continuous recording material R may be transported by using roller members or, for example, by using perforations or the like provided in the recording material R.

Typically, the image forming unit 2 forms an image electrophotographically. The image to be formed may be either a monochrome image or a color image. The image forming unit 2 may be either in contact with or out of contact with the recording material R at an image forming position TP, where the image forming unit 2 forms an image on the recording material R. The fixing unit 3 may be either in contact with or out of contact with the recording material R at a fixing position FP, where the fixing unit 3 fixes the image on the recording material R.

The method by which the detecting device 5 detects a change in the tension of the recording material R is not specifically limited. For example, the detecting device 5 may detect a change in the position of an associated member or a change in the load applied to an associated member that is caused by a change in the tension of the recording material R. The tension adjusting device 6 adjusts the tension of the recording material R if the change in the tension of the recording material R exceeds the permissible range. The tension may be adjusted by adjusting the speed of transport of the recording material R or the path of transport of the recording material R.

Typically, the detecting device 5 includes a shiftable member 5*a* and a position detector 5*b*. The shiftable member 5*a* is in contact with a non-image surface of the recording material R running between the image forming unit 2 and the fixing unit 3 and is shiftable in a direction intersecting the plane of the recording material R. The position detector 5*b* detects a change in the position of the shiftable member 5*a*. The shape of the shiftable member 5*a* is not specifically limited and may be a roller-like shape or a plate-like shape, typically. The shiftable member 5*a* only needs to be shiftable in a direction intersecting the plane of the recording material R. If the shiftable member 5*a* is shiftable in such a manner as not to change the direction of transport of the recording material R extending from the image forming position TP, the influence of electrical discharge or the like that may occur on the immediately downstream side of the image forming position TP is reduced.

The detecting device 5 may include a stretching member (corresponding to the shiftable member 5*a*) and a load detector (corresponding to the position detector 5*b*). The stretching member is in contact with the non-image surface of the recording material R running between the image forming unit 2 and the fixing unit 3 and thus stretches the recording material R. The load detector detects a change in the load acting on the stretching member. Such a load detector may detect the load acting on the stretching member by, for example, using a load cell.

The tension adjusting device 6 may adjust the speed of transport of the recording material R (hereinafter referred to as "the recording-material-transporting speed") in at least one of the fixing unit 3 and the collecting unit 4. An exemplary configuration in which the recording-material-transporting speed is adjusted in the fixing unit 3 and in the collecting unit 4 may be as follows: When the recording-material-transporting speed in the fixing unit 3 is increased, the recording-material-transporting speed in the collecting unit 4 is also increased; and when the recording-material-transporting speed in the fixing unit 3 is reduced, the recording-material-transporting speed in the collecting unit 4 is also reduced. In another exemplary configuration in which the recording-material-transporting speed is adjusted only in the fixing unit 3, a dancer roller or the like may be added to the collecting unit 4 so that the path of transport of the recording material R in the collecting unit 4 is changeable by using the dancer roller or the like.

From the viewpoint of reducing the pressure applied in the fixing unit 3, a torque limiting member that prevents the torque acting on the fixing unit 3 from exceeding an upper limit may be provided. In such a case, the tension adjusting device 6 adjusts the recording-material-transporting speed at least in the fixing unit 3 when the torque limiting member is not activated (that is, when the torque is at or below the upper limit), and adjusts the recording-material-transporting speed in the collecting unit 4 when the torque limiting member is activated (that is, when the torque has exceeded the upper limit). Needless to say, when the torque limiting member is not activated, the tension adjusting device 6 may adjust the recording-material-transporting speed both in the fixing unit 3 and in the collecting unit 4.

The fixing unit 3 may fix an image while being out of contact with the recording material R. In such a configuration, the tension adjusting device 6 adjusts the recording-material-transporting speed in the collecting unit 4. That is, the recording-material-transporting speed is not adjustable in the fixing unit 3 and is therefore adjusted in the collecting unit 4.

The detecting device 5 and the tension adjusting device 6 may be configured as follows. The detecting device 5 includes a shiftable member 5*a* and a position detector 5*b*. The shiftable member 5*a* is in contact with the non-image surface of the recording material R running between the image forming unit 2 and the fixing unit 3 and is shiftable in a direction intersecting the plane of the recording material R. The position detector 5*b* detects a change in the position of the shiftable member 5*a*. The tension adjusting device 6 includes a pressing member 6*a* that presses a position on the non-image surface of the recording material R running between the image forming unit 2 and the fixing unit 3, the position being different from the position of the shiftable member 5*a*. The pressing member 6*a* is movable in a direction intersecting the plane of the recording material R. The change in the tension of the recording material R is adjusted to fall within the permissible range by moving the pressing member 6*a*. The shape of the pressing member 6*a* is not specifically limited and may be a roller-like shape or a plate-like shape, typically. In addition to the shiftable member 5*a* and the pressing member 6*a*, another stretching member that is in contact with the non-image surface of the recording material R may be provided. Such a stretching member, if provided on the upstream side of the fixing unit 3, is easily applicable as the pressing member 6*a* in a case where the fixing unit 3 is of a non-contact type.

Further details of the present invention will now be described with reference to the accompanying drawings.

First Exemplary Embodiment

Overall Configuration of Image Forming Apparatus

Figure 2:
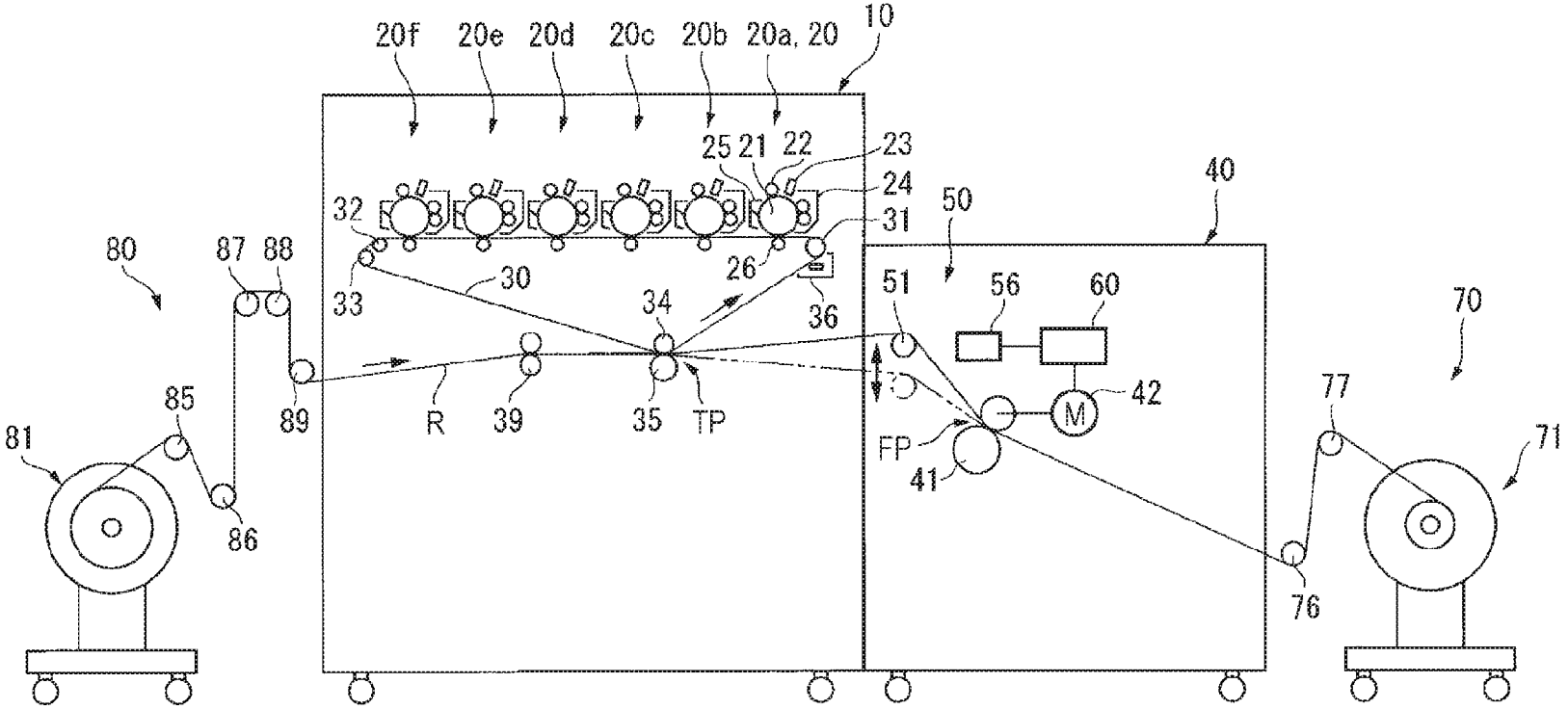
FIG. 2 outlines an image forming apparatus according to a first exemplary embodiment.

FIG. 2 outlines an image forming apparatus according to a first exemplary embodiment. The image forming apparatus illustrated in FIG. 2 includes an image-forming-apparatus body 10 provided in the center thereof, with a fixing machine 40 and a collecting machine 70 provided on the downstream side (the right side in FIG. 2) of the image-forming-apparatus body 10 in the direction of transport of the recording material R and a supplying machine 80 provided on the upstream side (the left side in FIG. 2) of the image-forming-apparatus body 10 in the direction of transport of the recording material R. The image-forming-apparatus body 10 includes image forming units capable of forming respective images on the recording material R. The fixing machine 40 includes a fixing unit that fixes the image formed on the continuous recording material R (hereinafter referred to as "the continuous paper R") by the image-forming-apparatus body 10. The collecting machine 70, corresponding to a collecting unit, winds and collects the continuous paper R that have undergone the fixing process. The supplying machine 80, corresponding to a supplying unit, supplies the continuous paper R, which is wound in a roll. The configuration of the image forming apparatus is not limited to the above. For example, the fixing machine 40 may be incorporated into the image-forming-apparatus body 10. Moreover, the image forming apparatus may further include a machine that performs any additional process on the continuous paper R.

Image-Forming-Apparatus Body

The image-forming-apparatus body 10 includes an endless intermediate transfer belt 30 that is stretched around and is rotatable around plural stretching rollers 31 to 34, and image forming engines 20 (20*a* to 20*f*) that form respective images on the intermediate transfer belt 30. The image forming engines 20 are provided above the intermediate transfer belt 30. While the first exemplary embodiment concerns a case where six electrophotographic image forming engines 20 (20*a* to 20*f*) are provided, the number of image forming engines 20 is not limited to six and may be one, for example.

Image Forming Engine

The image forming engines 20 all have the same configuration. Therefore, a representative one of the image forming engines 20 (specifically, the image forming engine 20*a*) will be described herein. The image forming engine 20 includes a photoconductor 21 provided in contact with the intermediate transfer belt 30; a charging device 22, such as a charging roller, that charges the photoconductor 21; a latent-image-drawing device 23 including, for example, an array of light-emitting diodes (LEDs) and that draws an electrostatic latent image on the photoconductor 21 charged by the charging device 22; a developing device 24 that visualizes the electrostatic latent image drawn on the photoconductor 21 by the latent-image-drawing device 23 into a toner image by using a developer containing a color toner; and a cleaning device 25 that removes residual toner particles from the photoconductor 21 after the visualization of the toner image by the developing device 24. The image forming engine 20 further includes a first transfer device 26, such as a first transfer roller, provided across the intermediate transfer belt 30 from the photoconductor 21 The first transfer device 26 first-transfers the toner image on the photoconductor 21 to the intermediate transfer belt 30. The above electrophotographic devices may each be any of a widely known devices. For example, the latent-image-drawing device 23 may be a laser scanning device instead of an LED array.

Intermediate Transfer Belt and Peripheral Elements

The toner images formed by the six image forming engines 20*a* to 20*f*, respectively, are sequentially first-transferred to the intermediate transfer belt 30, whereby the toner images are superposed one on top of another on the intermediate transfer belt 30.

The intermediate transfer belt 30 according to the first exemplary embodiment is rotatable in a direction indicated by the arrow in FIG. 2, with, for example, the stretching roller 31 serving as a driving roller and the stretching roller 33 serving as a tension applying roller. A second transfer device 35 includes, for example, a second transfer roller and is provided across the intermediate transfer belt 30 from the stretching roller 34. The second transfer device 35 transports the continuous paper R that is nipped between the second transfer device 35 and the intermediate transfer belt 30. Furthermore, the second transfer device 35 produces a second-transfer electric field with the stretching roller 34 serving as a counter electrode. Thus, the toner images superposed on the intermediate transfer belt 30 are collectively transferred to the continuous paper R.

In the first exemplary embodiment, the image forming engines 20, the intermediate transfer belt 30, and the second transfer device 35 that in co-operation form toner images on the continuous paper R are collectively regarded as an image forming unit, and the nip between the intermediate transfer belt 30 and the second transfer device 35 corresponds to the image forming position TP (hereinafter referred to as "the transfer position TP"). A belt cleaning device 36 is provided at a position on the downstream side with respect to the transfer position TP in the direction of rotation of the intermediate transfer belt 30 and across the intermediate transfer belt 30 from, for example, the stretching roller 31. The belt cleaning device 36 removes residual toner particles from the intermediate transfer belt 30. A pair of transport rollers 39 positions the continuous paper R and transports the continuous paper R toward the transfer position TP.

Fixing Machine

The fixing machine 40 according to the first exemplary embodiment includes a fixing device 41. The fixing device 41 includes, for example, a heating roller and a pressing roller that fix the toner images collectively transferred from the intermediate transfer belt 30 to the continuous paper R in the image-forming-apparatus body 10. The fixing device 41 is a contact-type device that is in contact with the continuous paper R. The fixing device 41 is configured such that the speed of rotation of the rollers is changeable by a motor 42. In the first exemplary embodiment, the position where the fixing device 41 is in contact with the continuous paper R is regarded as the fixing position FP.

Detecting Device and Tension Adjusting Device

In the first exemplary embodiment, the fixing machine 40 includes a detecting device 50 and a tension adjusting device 60. The detecting device 50 detects a change in the tension of the continuous paper R running between the transfer position TP and the fixing position FP. If the change in the tension of the continuous paper R that is detected by the detecting device 50 exceeds a predetermined permissible range, the tension adjusting device 60 adjusts the tension of the continuous paper R such that the change in the tension of the continuous paper R falls within the permissible range.

The detecting device 50 includes a movable roller 51 as a shiftable member, and a sensor 56 as a position detector. The movable roller 51 is in contact with the non-image surface of the continuous paper R running between the transfer position TP and the fixing position FP and is shiftable in a direction intersecting the plane of the continuous paper R. The sensor 56 detects the change in the position of the movable roller 51. The movable roller 51 is positioned in contact with the non-image surface of the continuous paper R in such a manner as to form a bent part in the continuous paper R, the bent part being convex toward the image-surface side. The sensor 56 is configured to detect the position of the movable roller 51.

The tension adjusting device 60 adjusts the speed of rotation of the motor 42 of the fixing device 41. While the first exemplary embodiment concerns a case where the detecting device 50 and the tension adjusting device 60 are provided in the fixing machine 40, the present invention is not limited to such a case. Needless to say, at least one of the detecting device 50 and the tension adjusting device 60 may be provided in the image-forming-apparatus body 10.

Collecting Machine

The collecting machine 70 according to the first exemplary embodiment includes a winding device 71 that winds the continuous paper R having passed through the fixing machine 40, and guiding members 76 and 77 that guide the continuous paper R to the winding device 71 while stretching the continuous paper R, and other associated elements.

Supplying Machine

The supplying machine 80 according to the first exemplary embodiment includes an unwinding device 81 that unwinds the continuous paper R, guiding members 85 to 89 that guide the continuous paper R from the unwinding device 81 toward the image-forming-apparatus body 10 while stretching the continuous paper R, and other associated elements. Any of the guiding members 85 to 89 may also serve as a dancer roller that stabilizes the transport of the continuous paper R or a walking roller that prevents the meandering of the continuous paper R. Moreover, at least one of the guiding members 85 to 89 may be provided in the image-forming-apparatus body 10.

Details of Detecting Device and Tension Adjusting Device

The detecting device 50 and the tension adjusting device 60 according to the first exemplary embodiment will now be described in further details.

Figure 3A:
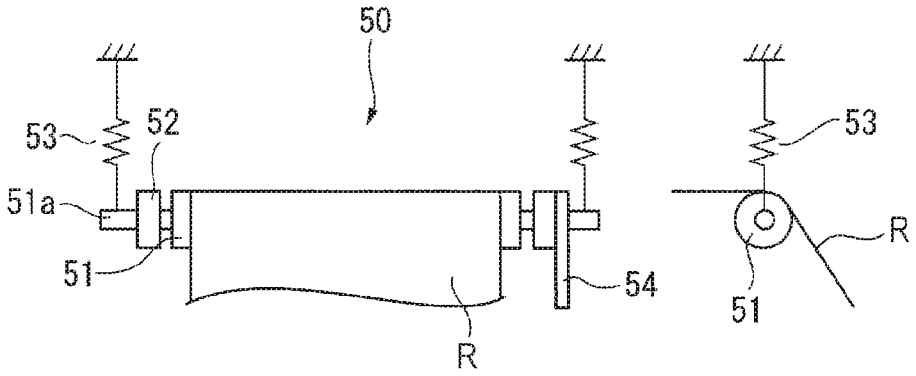
FIG. 3A illustrates a configuration of a detecting device according to the first exemplary embodiment.

FIG. 3A includes diagrams of the detecting device 50, the diagram on the right being a side view of the diagram on the left. As illustrated in FIG. 3A, the detecting device 50 includes the movable roller 51, bearings 52 that hold a rotating shaft 51*a* of the movable roller 51 while allowing the rotation of the rotating shaft 51*a* and is movable linearly by a guide member (not illustrated), a pair of urging members 53 attached to the rotating shaft 51*a* and that urge the movable roller 51 in such a direction that the continuous paper R is stretched, and a plate-like strip 54 a part of which is fixed to one of the bearings 52.

Figure 3B:
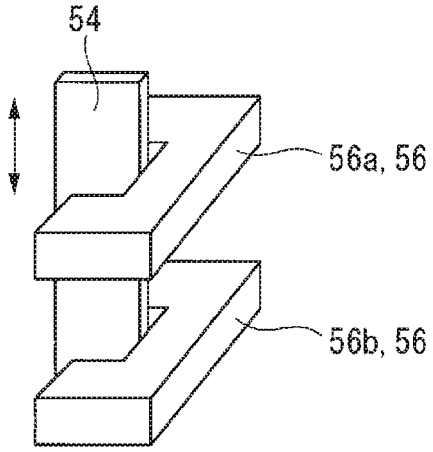
FIG. 3B illustrates the relationship between a sensor and a plate-like strip according to the first exemplary embodiment.
Figure 3C:
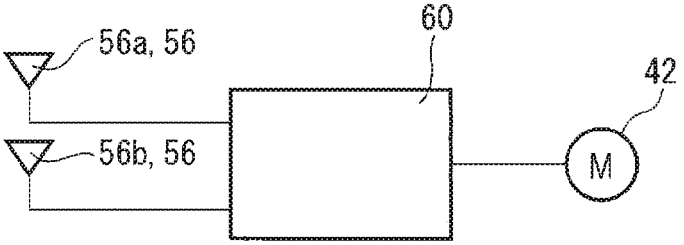
FIG. 3C illustrates the relationship between the sensor and a tension adjusting device.

FIG. 3B illustrates the relationship between the sensor 56 and the plate-like strip 54 according to the first exemplary embodiment. The sensor 56 according to the first exemplary embodiment includes two sensors 56 (56*a* and 56*b*, also denoted as "sensor 1" and "sensor 2") arranged side by side in a direction intersecting the plane of the continuous paper R. The two sensors 56*a* and 56*b* according to the first exemplary embodiment are each, for example, a photo-interrupter and detect the position of the plate-like strip 54 on the basis of whether or not the plate-like strip 54 is interrupting the optical path of the photo-interrupter. FIG. 3C illustrates the relationship between the tension adjusting device 60 and the two sensors 56*a* and 56*b*. In accordance with information acquired from the two sensors 56*a* and 56*b*, the tension adjusting device 60 adjusts the speed of rotation of the motor 42 and thus adjusts the recording-material-transporting speed in the fixing device 41 (see FIG. 2).

Now, how the tension adjusting device 60 adjusts the recording-material-transporting speed in the fixing device 41 will be described.

Figures 4A, 4B:
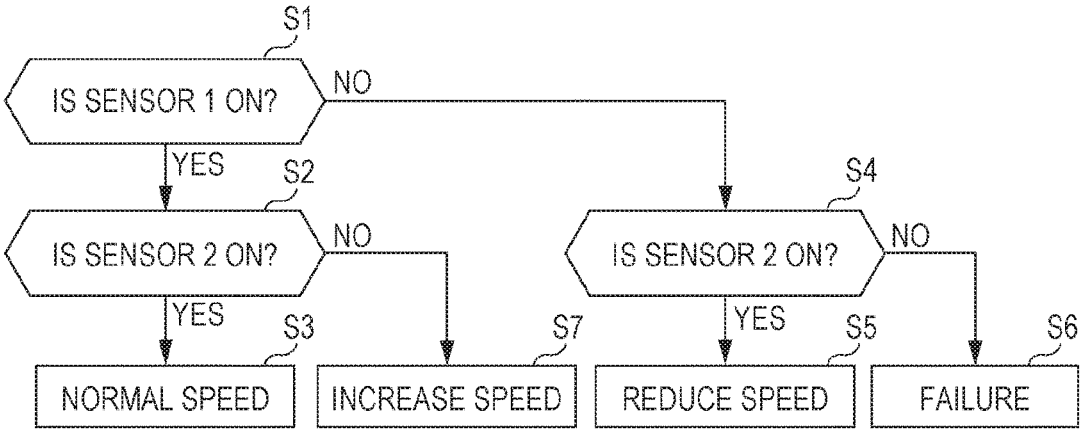
FIG. 4A is a flow chart illustrating an adjustment process according to the first exemplary embodiment.
FIG. 4B is a table summarizing the relationship between information acquired from the sensors and the speed of transport.

FIG. 4A is a flow chart illustrating the adjustment process. In step S1, whether or not the sensor 1 (56*a*), which is the upper one, is on is checked so as to locate the plate-like strip 54 with respect to the two sensors 56*a* and 56*b* (the sensor 1 and the sensor 2). In the first exemplary embodiment, the "on" state refers to a state where the plate-like strip 54 is interrupting the optical path of the sensor 56*a* or 56*b*. If the sensor 1 (56*a*) is on, the process proceeds to step S2, where whether or not the sensor 2 (56*b*) is on is checked. If the sensor 2 (56*b*) is on, the process proceeds to step S3, where the recording-material-transporting speed in the fixing device 41 is set to a predetermined normal speed, that is, the speed of rotation of the motor 42 is set to a predetermined normal speed.

If it is determined that the sensor 1 (56*a*) is off in step S1, the process proceeds to step S4, where whether or not the sensor 2 (56*b*) is on is checked. If the sensor 2 (56*b*) is on, the process proceeds to step S5, where the recording-material-transporting speed in the fixing device 41 is reduced from the normal speed. If the sensor 2 (56*b*) is off in step S4, the process proceeds to step S6, where it is determined that there is a failure, and the image forming process is stopped so that the cause of the failure is identified and addressed. If the sensor 2 (56*b*) is off in step S2, the process proceeds to step S7, where the recording-material-transporting speed in the fixing device 41 is increased from the predetermined normal speed.

As described above, the position of the plate-like strip 54, i.e., the position to which the movable roller 51 is shifted, is detected on the basis of the information acquired from the two sensors 56*a* and 56*b*, and the recording-material-transporting speed in the fixing device 41 is adjusted in accordance with the detected position of the plate-like strip 54.

FIG. 4B is a table summarizing the relationship between the information acquired from the two sensors 56*a* and 56*b* and the recording-material-transporting speed in the fixing device 41. According to this table, if both the sensor 1 (56*a*) and the sensor 2 (56*b*) are on, it is determined that the degree of stretching of the continuous paper R between the transfer position TP and the fixing position FP is normal, and the recording-material-transporting speed in the fixing device 41 is maintained at the normal speed. If the sensor 1 (56*a*) is on while the sensor 2 (56*b*) is off, it is determined that the degree of stretching of the continuous paper R is looser than normal, and the recording-material-transporting speed in the fixing device 41 is increased to become higher than the normal speed. If the sensor 1 (56*a*) is off while the sensor 2 (56*b*) is on, it is determined that the degree of stretching of the continuous paper R is tighter than normal, and the recording-material-transporting speed in the fixing device 41 is reduced to become lower than the normal speed. That is, according to the first exemplary embodiment, the range within which the plate-like strip 54 turns both of the two sensors 56*a* and 56*b* on is regarded as the normal range (the permissible range). Hence, if the plate-like strip 54 goes out of the range detectable by at least one of the sensors 56*a* and 56*b*, the recording-material-transporting speed in the fixing device 41 is adjusted.

Figure 5:
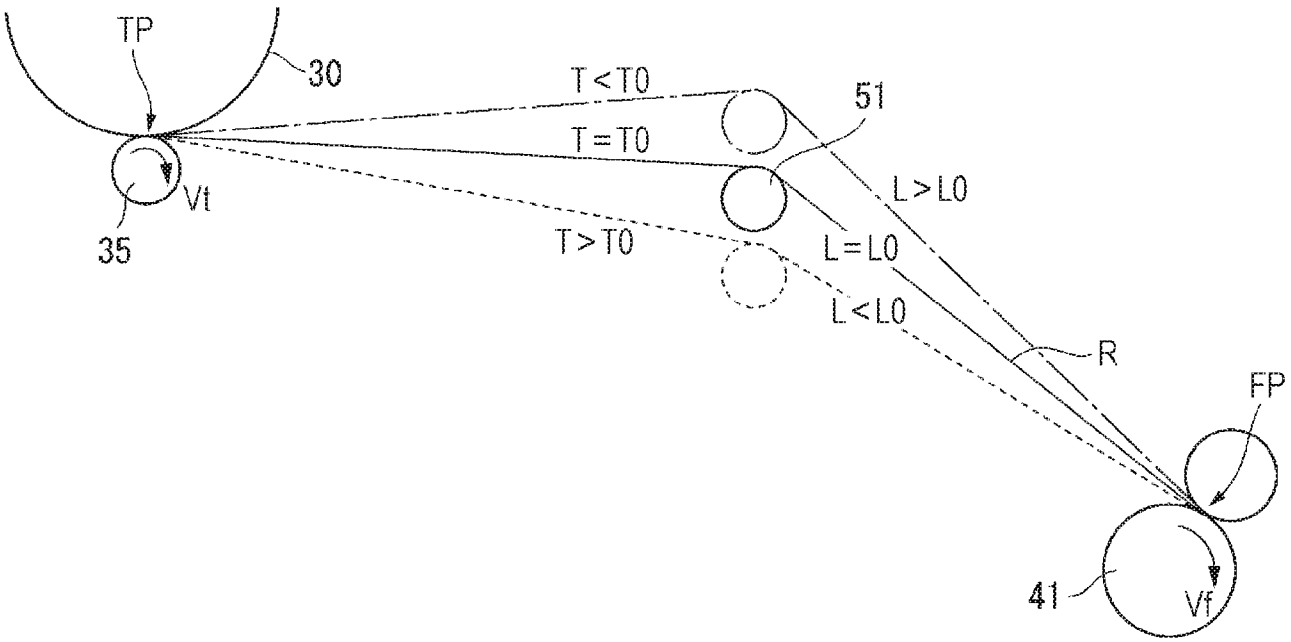
FIG. 5 schematically illustrates how the tension of a continuous paper changes between a transfer position and a fixing position.

Now, how the continuous paper R behaves between the transfer position TP and the fixing position FP in the first exemplary embodiment will be described. FIG. 5 schematically illustrates how the tension of the continuous paper R changes between the transfer position TP and the fixing position FP. In FIG. 5, the solid line represents the continuous paper R that is at the normal position (tension T=T0, and length L of the recording-material-transport path between the transfer position TP and the fixing position FP=L0). For example, suppose that a recording-material-transporting speed Vt at the transfer position TP has become higher than a recording-material-transporting speed Vf at the fixing position FP (Vt>Vf). In such a case, the length L of the recording-material-transport path between the transfer position TP and the fixing position FP becomes longer than normal (L>L0) as represented by the dash-dot line, and the tension T becomes lower than normal (T<T0). Consequently, the movable roller 51 is shifted upward (in such a direction as to further stretch the continuous paper R), and information on this shift is detected by the two sensors 56*a* and 56*b*. If the amount of shift exceeds the permissible range, the recording-material-transporting speed Vf in the fixing device 41 is increased to become higher than a normal speed Vf0 (Vf>Vf0). Since the recording-material-transporting speed Vf in the fixing device 41 is increased, the length L of the recording-material-transport path starts to be reduced. Consequently, the movable roller 51 is lowered and returns to the normal position.

Now, suppose that the recording-material-transporting speed Vt at the transfer position TP has become lower than the recording-material-transporting speed Vf at the fixing position FP (Vt<Vf). In such a case, the length L of the recording-material-transport path between the transfer position TP and the fixing position FP becomes shorter than normal (L<L0) as represented by the broken line, and the tension T becomes higher than normal (T>T0). Consequently, the movable roller 51 is shifted downward (in such a direction as to loosen the continuous paper R), and information on this shift is detected by the two sensors 56*a* and 56*b*, whereby the recording-material-transporting speed Vf in the fixing device 41 is reduced to become lower than the normal speed Vf0 (Vf<Vf0). Since the recording-material-transporting speed Vf in the fixing device 41 is reduced, the length L of the recording-material-transport path starts to be increased. Consequently, the movable roller 51 is raised and returns to the normal position.

In general, the toner images on the continuous paper R is unfixed in an area between the transfer position TP and the fixing position FP, that is, toner particles are only electrostatically attracted to the continuous paper R (under a certain level of Coulomb force, basically). Hence, if the degree of stretching (corresponding to the tension) of the continuous paper R in this area is different from the normal tension, any of the following troubles may occur. For example, if the degree of stretching of the continuous paper R becomes too low, the continuous paper R may flap unnecessarily while being transported. In such an event, for example, some of the unfixed toner particles on the continuous paper R may scatter and may cause an image defect. On the other hand, if the degree of stretching of the continuous paper R becomes too high, a great load is applied to the continuous paper R, and the continuous paper R may be damaged or wrinkled, for example.

According to the first exemplary embodiment, the degree of stretching of the continuous paper R between the transfer position TP and the fixing position FP is adjusted to be within the predetermined permissible range. Therefore, the occurrence of troubles such as image defects and damage to the continuous paper R is suppressed. In the first exemplary embodiment, the angle formed between the continuous paper R and the intermediate transfer belt 30 on the downstream side of the transfer position TP in the direction of transport of the continuous paper R is adjusted by the shifting of the movable roller 51 in such a manner as to fall within a predetermined range. Hence, the continuous paper R is prevented from being brought unnecessarily close to the intermediate transfer belt 30, so that problems such as the scattering of toner particles due to electric discharge between the continuous paper R and the intermediate transfer belt 30 are avoided.

While the first exemplary embodiment concerns a case where the two sensors 56*a* and 56*b* serving as photo-interrupters are employed, the sensors 56*a* and 56*b* may be, for example, photo-sensors, a combination of a Hall element and a magnet, or a combination of a coil and a magnetic material. Moreover, the number of sensors is not specifically limited as long as the sensors are capable of providing any information for determining the position to which the movable roller 51 is shifted, and such sensors only need to be arranged in accordance with the detecting method to be employed.

While the first exemplary embodiment concerns a case where the pair of urging members 53 that urge the movable roller 51 are extension springs as illustrated in FIG. 3A, the pair of urging members 53 may be, for example, compression springs that press the movable roller 51 against the continuous paper R. Alternatively, the pair of urging members 53 may be leaf springs or the like instead of coil springs.

While the first exemplary embodiment concerns a case where the continuous paper R is transported while being nipped between the intermediate transfer belt 30 and the second transfer device 35 at the transfer position TP, the continuous paper R does not necessarily need to be nipped at the transfer position TP. The detecting device 50 and the tension adjusting device 60 described above may also be employed in a case where, for example, a corona charger such as a corotron is used in replacement of the second transfer device 35. Needless to say, the speed of transport of the continuous paper R at the transfer position TP is determined by the speed of image formation performed by the image forming engine 20.

Modification

Figure 6:
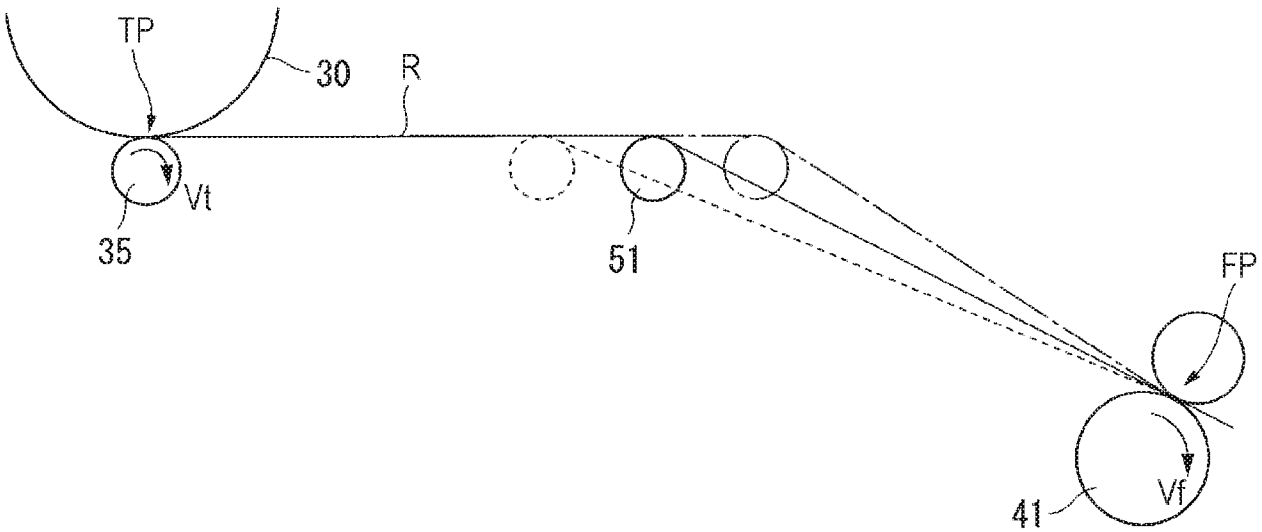
FIG. 6 schematically illustrates how a movable roller included in the detecting device according to a modification of the first exemplary embodiment is shifted.

FIG. 6 schematically illustrates how the movable roller 51 of the detecting device 50 according to a modification of the first exemplary embodiment is shifted. Referring to FIG. 6, the movable roller 51 according to the first modification differs from the movable roller 51 according to the first exemplary embodiment in the direction of shifting. The movable roller 51 according to the first modification is shifted in the direction in which the continuous paper R is transported from the transfer position TP, regardless of whether or not the direction intersects the plane of the continuous paper R. In FIG. 6, the solid line represents the normal position of the continuous paper R, the dash-dot line represents the position of the continuous paper R that is looser than normal between the transfer position TP and the fixing position FP, and the broken line represents the position of the continuous paper R that is tighter than normal between the transfer position TP and the fixing position FP.

In the first modification, the shifting of the movable roller 51 according to the degree of stretching of the continuous paper R is performed such that the direction of transport of the continuous paper R from the transfer position TP does not change. Therefore, the direction of transport of the continuous paper R from the transfer position TP is constant, and the occurrence of scattering of toner particles or the like is suppressed. If electric discharge occurs on the immediately downstream side of the transfer position TP between the continuous paper R and the intermediate transfer belt 30, troubles such as the scattering of unfixed toner particles on the continuous paper R may occur.

Second Exemplary Embodiment

Figure 7:
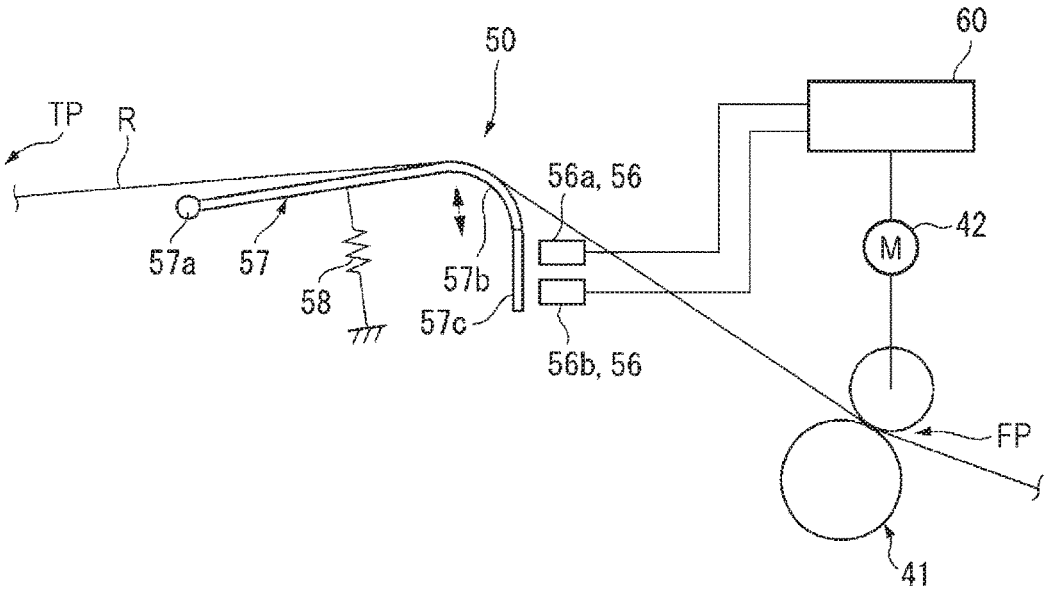
FIG. 7 outlines a detecting device according to a second exemplary embodiment FIG. 8 outlines a detecting device according to a third exemplary embodiment.

FIG. 7 outlines a detecting device 50 according to a second exemplary embodiment. The detecting device 50 according to the second exemplary embodiment illustrated in FIG. 7 has substantially the same configuration as the detecting device 50 according to the first exemplary embodiment, except that a plate-like member 57 is employed as the shiftable member in replacement of the movable roller 51 employed in the first exemplary embodiment. The configuration of an image forming apparatus according to the second exemplary embodiment is substantially the same as in the first exemplary embodiment, and the description thereof is therefore omitted. Elements that are the same as those described in the first exemplary embodiment are denoted by corresponding ones of the reference numerals used in the first exemplary embodiment, and redundant description thereof is omitted.

The plate-like member 57 according to the second exemplary embodiment includes a rotating shaft 57*a*, an arc-shaped portion 57*b*, and a projecting portion 57*c*. The rotating shaft 57*a* is positioned on the upstream side of the plate-like member 57 in the direction of transport of the continuous paper R. The arc-shaped portion 57*b* is supported by the rotating shaft 57*a* in such a manner as to be swingable about the rotating shaft 57*a*. The arc-shaped portion 57*b* curves downward toward the downstream end of the plate-like member 57. The projecting portion 57*c* is positioned at the downstream end of the plate-like member 57 and extends substantially linearly to a position outside an area defined by the width of the continuous paper R. The plate-like member 57 is provided with an urging member 58. The urging member 58 lifts the plate-like member 57 toward the continuous paper R, whereby the arc-shaped portion 57*b* of the plate-like member 57 is pressed against the non-image surface of the continuous paper R.

In the second exemplary embodiment, the position of the projecting portion 57*c* of the plate-like member 57 is detected by the sensor 56 in the same manner as in the first exemplary embodiment, whereby the position of the plate-like member 57 is identified, and the degree of stretching of the continuous paper R between the transfer position TP and the fixing position FP is detected.

In the second exemplary embodiment, the degree of stretching of the continuous paper R between the transfer position TP and the fixing position FP is detected as the change in the position of the plate-like member 57, and the tension adjusting device 60 adjusts the recording-material-transporting speed in the fixing device 41 on the basis of the result of the detection. Thus, the occurrence of troubles regarding the continuous paper R is suppressed. The urging member 58 may be, for example, a coil spring, a leaf spring, a torsion spring, or the like.

While the second exemplary embodiment concerns a case where the plate-like member 57 is lifted by the urging member 58 provided below the plate-like member 57, the plate-like member 57 may be lifted by, for example, an extension spring provided above the plate-like member 57. Furthermore, while the second exemplary embodiment concerns a case where the rotating shaft 57*a* of the plate-like member 57 is positioned on the upstream side in the direction of transport of the continuous paper R, the rotating shaft 57*a* may be positioned on the downstream side.

Furthermore, while the second exemplary embodiment concerns a case where the plate-like member 57 including the arc-shaped portion 57*b* is employed, the arc-shaped portion 57*b* of the plate-like member 57 may be replaced with, for example, a roller member that is swingable about the rotating shaft 57*a*.

Third Exemplary Embodiment

Figure 8:
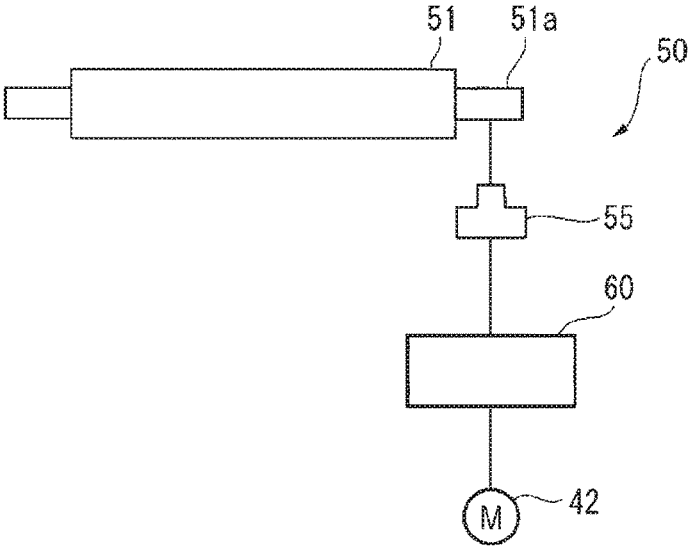

FIG. 8 outlines a detecting device 50 according to a third exemplary embodiment. The detecting device 50 according to the third exemplary embodiment differs from the detecting device 50 according to the first exemplary embodiment (see FIG. 2) in that the load acting on the movable roller 51 serving as a stretching member is detected so that the degree of stretching of the continuous paper R is determined. Elements that are the same as those described in the first exemplary embodiment are denoted by corresponding ones of the reference numerals used in the first exemplary embodiment, and redundant description thereof is omitted.

Referring to FIG. 8, the detecting device 50 according to the third exemplary embodiment includes a movable roller 51 as a stretching member that is in contact with the non-image surface of the continuous paper R and stretches the continuous paper R, and a load cell 55 that detects a change in the load acting on the movable roller 51. In the tension adjusting device 60, a range of load under which the degree of stretching of the continuous paper R is within the normal range is set to the permissible range. If the load is below the permissible range, it is determined that the continuous paper R is loose. Therefore, the recording-material-transporting speed in the fixing device 41 is increased to become higher than the normal speed. If the load exceeds the permissible range, it is determined that the continuous paper R is too tight. Therefore, the recording-material-transporting speed in the fixing device 41 is reduced to become lower than the normal speed.

Hence, the third exemplary embodiment also exerts the functions exerted by the first exemplary embodiment. While the third exemplary embodiment concerns a case where the load cell 55 is provided at one end of the rotating shaft 51*a* of the movable roller 51, the load cell 55 may be provided at each of the two ends of the rotating shaft 51*a*. In that case, the determination may be made by averaging the results detected by the two load cells 55 or on the basis of the result detected by one of the two load cells 55. Alternatively, the load may be detected by using the plate-like member 57 (see FIG. 7) employed in the second exemplary embodiment, instead of the movable roller 51. Moreover, while the third exemplary embodiment employs the load cell 55, any device that is capable of detecting the load may be employed.

While the third exemplary embodiment employs the movable roller 51 as a stretching member, the movable roller 51 does not necessarily need to be shifted in the way described in the first exemplary embodiment. The movable roller 51 only needs to be shiftable to such an extent that the change in the load indicating the degree of stretching of the continuous paper R is detectable.

Fourth Exemplary Embodiment

Figure 9:
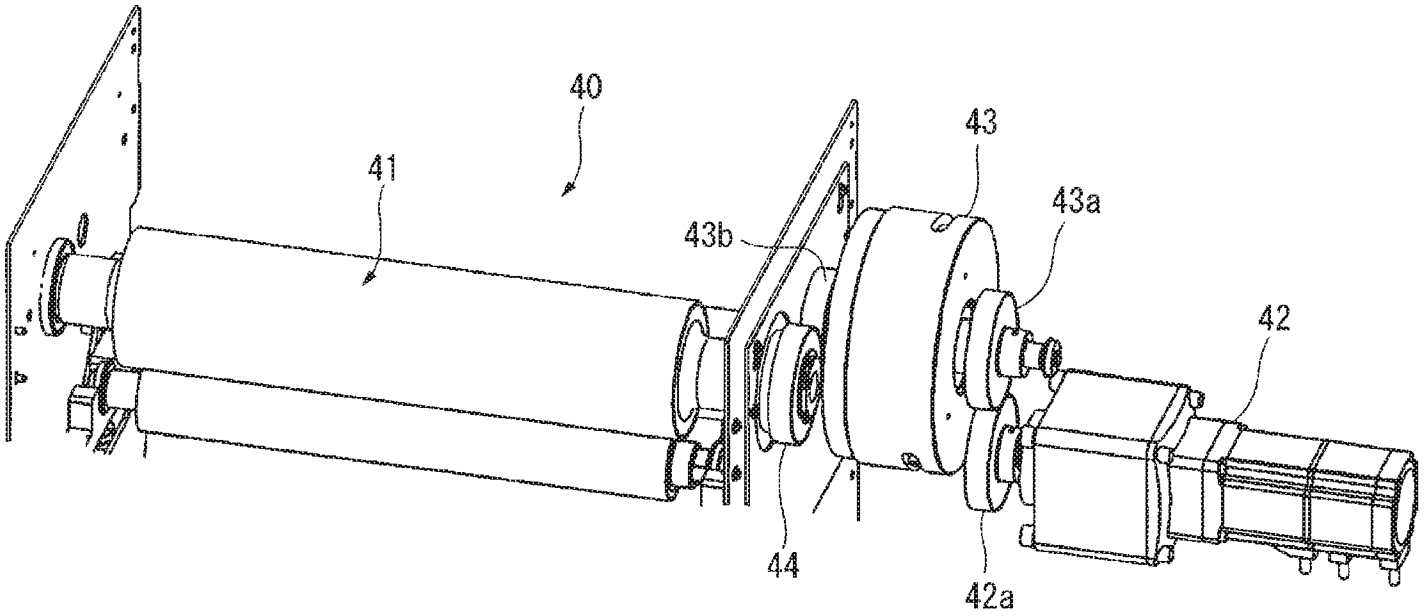
FIG. 9 outlines a fixing device according to a fourth exemplary embodiment.

FIG. 9 outlines a fixing machine 40 according to a fourth exemplary embodiment. The fixing machine 40 according to the fourth exemplary embodiment has substantially the same configuration as the fixing machine 40 according to the first exemplary embodiment (see FIG. 2), except that a torque limiter 43 as a torque limiting member that prevents the torque acting on the fixing device 41 from exceeding an upper limit is provided. Elements that are the same as those described in the first exemplary embodiment are denoted by corresponding ones of the reference numerals used in the first exemplary embodiment, and redundant description thereof is omitted.

In the fourth exemplary embodiment illustrated in FIG. 9, the rotational driving force generated by the motor 42 is transmitted from a motor gear 42*a* attached to the motor 42, through an input-side gear 43*a* of the torque limiter 43, to the torque limiter 43. The rotational driving force is further transmitted from an output-side gear 43*b* of the torque limiter 43, through a fixing gear 44 of the fixing device 41, to the fixing device 41.

If a torque that is within a predetermined range of torque acts on the fixing device 41, the torque limiter 43 allows the rotational driving force generated by the motor 42 to be transmitted as it is to the fixing device 41. If a torque that exceeds the predetermined range of torque acts on the fixing device 41, the rotational driving force generated by the motor 42 is prevented from being transmitted to the fixing device 41. In that case, the fixing device 41 is allowed to rotate freely, independent of the rotational driving force of the motor 42.

Figure 10:
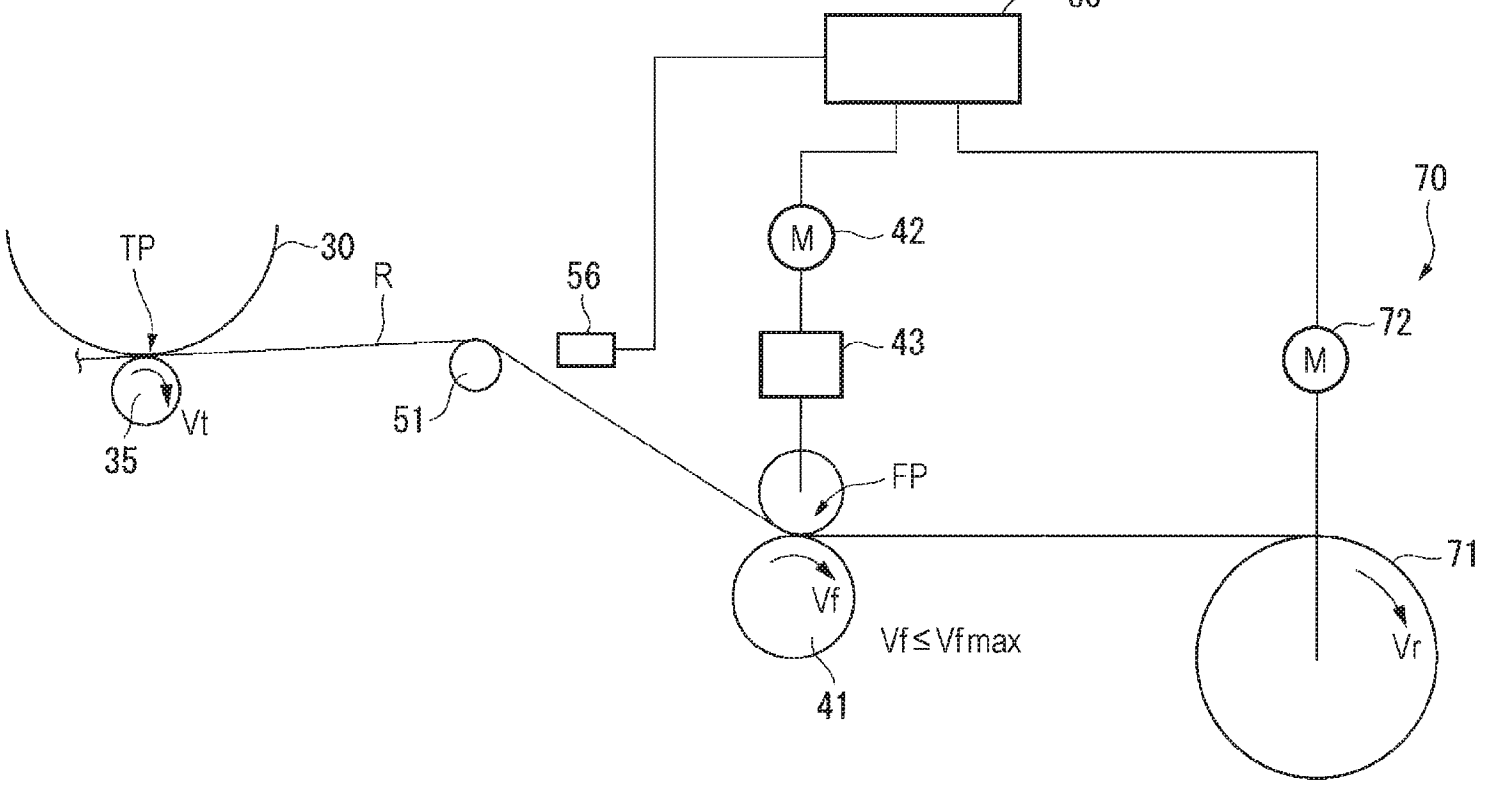
FIG. 10 illustrates how a tension adjusting device according to the fourth exemplary embodiment adjusts the recording-material-transporting speed.

FIG. 10 illustrates how the tension adjusting device 60 according to the fourth exemplary embodiment adjusts the recording-material-transporting speed. Referring to FIG. 10, the tension adjusting device 60 according to the fourth exemplary embodiment adjusts the speed of rotation of the motor 42 of the fixing device 41 and the speed of rotation of a motor 72 of the winding device 71 on the basis of the information acquired from the sensor 56. Thus, the tension adjusting device 60 adjusts the recording-material-transporting speed in the fixing device 41 and a recording-material-winding speed in the winding device 71 of the collecting machine 70.

In the fourth exemplary embodiment, the relationship among the recording-material-transporting speed Vt at the transfer position TP, the recording-material-transporting speed Vf at the fixing position FP, and the recording-material-winding speed (corresponding to the speed of transport) Vr in the winding device 71 is as follows.

If $Vt>Vf$, the continuous paper R running between the transfer position TP and the fixing position FP is loosened (the tension is reduced). Therefore, Vf is increased. If $Vt<Vf$, Vf is reduced. Thus, the degree of stretching of the continuous paper R between the transfer position TP and the fixing position FP is adjusted.

In the fourth exemplary embodiment, however, since the motor 42 of the fixing device 41 is provided with the torque limiter 43, a maximum value Vfmax of the recording-material-transporting speed Vf in the fixing device 41 is set by the torque limiter 43, so that, for example, Vf is not allowed to exceed Vfmax (Vf ≤Vfmax). Hence, only the recording-material-winding speed Vr in the winding device 71 is adjusted.

That is, in the fourth exemplary embodiment, the degree of stretching of the continuous paper R between the transfer position TP and the fixing position FP is adjusted by basically adjusting the recording-material-transporting speed Vf in the fixing device 41 before the recording-material-transporting speed Vf in the fixing device 41 exceeds Vfmax. If the recording-material-transporting speed Vf exceeds Vfmax, the recording-material-winding speed Vr in the winding device 71 is adjusted, whereby the degree of stretching of the continuous paper R between the transfer position TP and the fixing position FP is adjusted.

Hence, the force of transporting the recording material in the fixing device 41 is prevented from becoming too large, and the fixing process is therefore stabilized. If the force of transporting the recording material in the fixing device 41 is increased too much, a large contact pressure needs to be applied to the continuous paper R in the fixing process. Consequently, problems such as the diffusion of the resulting image or the acceleration of the deterioration of associated members may occur.

Fifth Exemplary Embodiment

Figure 11:
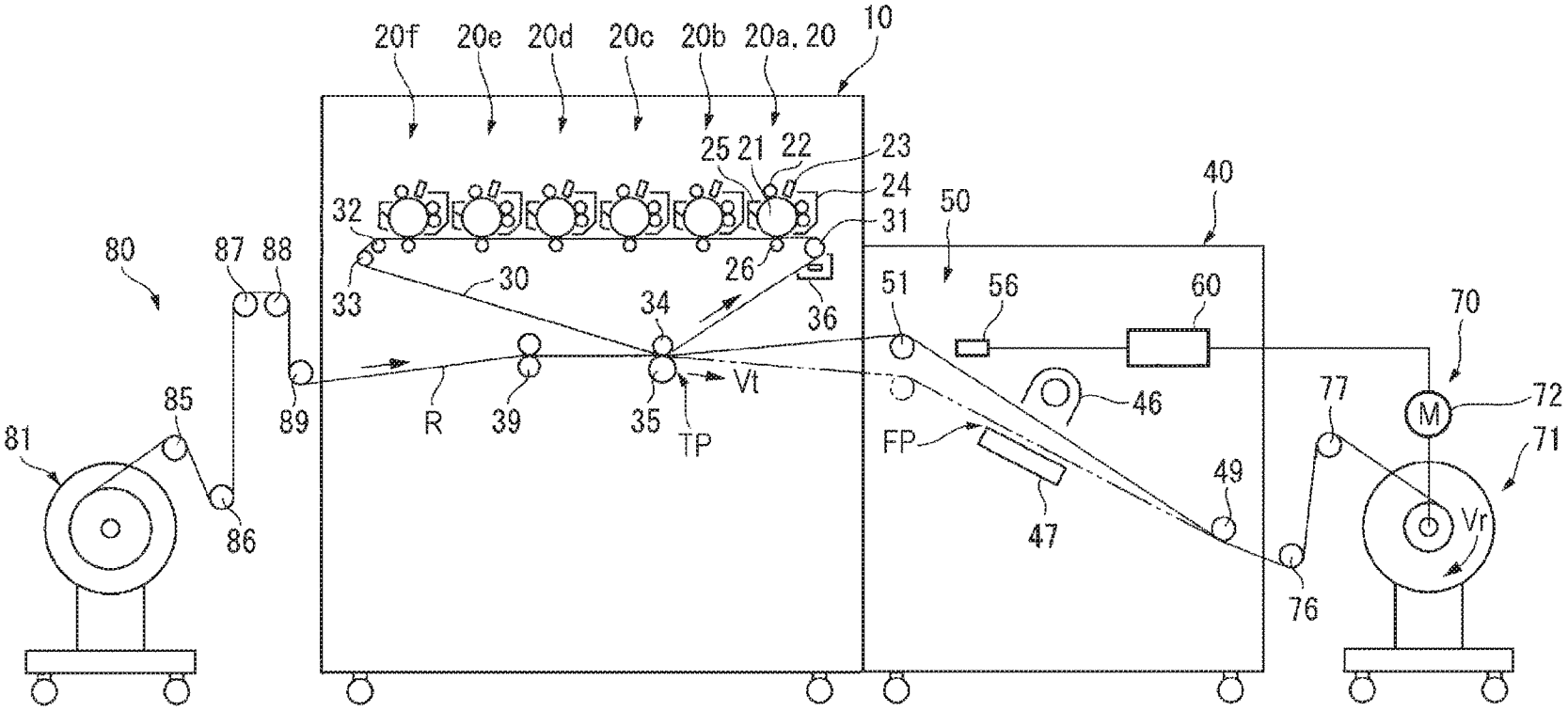
FIG. 11 outlines an image forming apparatus according to a fifth exemplary embodiment.

FIG. 11 outlines an image forming apparatus according to a fifth exemplary embodiment. The image forming apparatus according to the fifth exemplary embodiment has substantially the same configuration as the image forming apparatus according to the first exemplary embodiment (see FIG. 2), except that the fixing machine 40 has a different shape from the fixing machine 40 according to the first exemplary embodiment. Elements that are the same as those described in the first exemplary embodiment are denoted by corresponding ones of the reference numerals used in the first exemplary embodiment, and redundant description thereof is omitted.

The fixing machine 40 according to the fifth exemplary embodiment differs from the fixing device 41 according to the first exemplary embodiment (see FIG. 2), which fixes the image by being in contact with the continuous paper R. The fixing machine 40 according to the fifth exemplary embodiment fixes the image while being out of contact with the continuous paper R and includes a flash lamp 46 for heating the image surface of the continuous paper R, and a reflecting panel 47 provided on the non-image-surface side of the continuous paper R. The tension adjusting device 60 according to the fifth exemplary embodiment adjusts the recording-material-winding speed Vr in the winding device 71 by adjusting the speed of rotation of the motor 72 of the winding device 71 in accordance with the information acquired from the sensor 56 that detects the position of the movable roller 51 provided in the path in which the continuous paper R is transported between the transfer position TP and the fixing position FP. Therefore, in the fifth exemplary embodiment, the recording-material-transporting speed Vt between the transfer position TP and the winding device 71 is adjusted by adjusting the recording-material-winding speed Vr in the winding device 71.

In the fifth exemplary embodiment, the relationship between the recording-material-transporting speed Vt at the transfer position TP and the recording-material-winding speed (corresponding to the speed of transport) Vr in the winding device 71 is as follows.

If Vt>Vr, the continuous paper R running between the transfer position TP and the fixing position FP is loosened (the tension is reduced). Therefore, Vr is increased. If Vt<Vr, Vr is reduced. Thus, the degree of stretching of the continuous paper R between the transfer position TP and the fixing position FP is adjusted. The continuous paper R is stretched and guided by a guiding member 49. While the fifth exemplary embodiment concerns a case where the guiding member 49 is included in the fixing machine 40, the guiding member 49 may be included in the collecting machine 70, of course.

While the fifth exemplary embodiment employs the movable roller 51 as a shiftable member, the movable roller 51 may be replaced with the plate-like member 57 (see FIG. 7) employed in the second exemplary embodiment, of course.

Sixth Exemplary Embodiment

Figure 12:
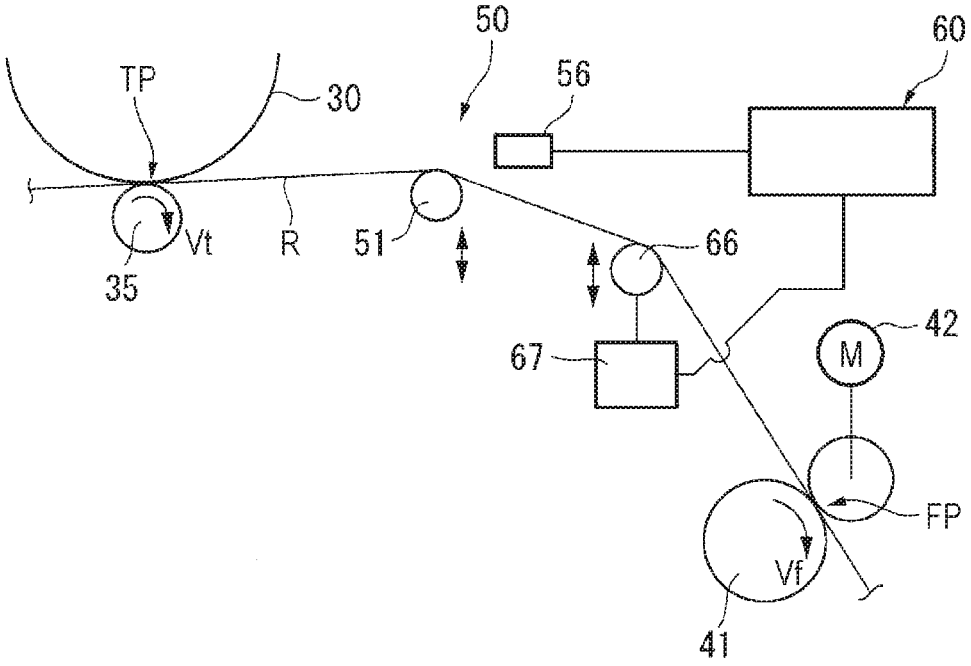
FIG. 12 outlines an adjusting operation performed by a tension adjusting device according to a sixth exemplary embodiment.

FIG. 12 outlines an adjusting operation performed by a tension adjusting device 60 according to a sixth exemplary embodiment. The tension adjusting device 60 according to the sixth exemplary embodiment differs from the tension adjusting device 60 according to the first exemplary embodiment (see FIG. 2) in that the degree of stretching of the continuous paper R is directly adjusted, not by adjusting the speed of rotation of the fixing device 41. Elements that are the same as those described in the first exemplary embodiment are denoted by corresponding ones of the reference numerals used in the first exemplary embodiment, and redundant description thereof is omitted.

Referring to FIG. 12, the tension adjusting device 60 according to the sixth exemplary embodiment includes a pressing member 66 provided at a position different from the movable roller 51 and in such a manner as to press the non-image surface of the continuous paper R running between the transfer position TP and the fixing position FP. The pressing member 66 is movable in a direction intersecting the plane of the continuous paper R. By moving the pressing member 66, the change in the tension of the continuous paper R is adjusted to fall within the permissible range.

The movable roller 51 according to the sixth exemplary embodiment is provided in the same manner as in the first exemplary embodiment. The pressing member 66 is not limited to a roller member and may have any shape, such as a plate-like shape, as long as the shape of the pressing member 66 does not give any adverse influences, such as damage to the continuous paper R, while the pressing member 66 is in contact with the continuous paper R.

The pressing member 66 according to the sixth exemplary embodiment is movable by a moving device 67 in a direction intersecting the plane of the continuous paper R as indicated by a double-head arrow in FIG. 12, for example. The moving device 67 may move the pressing member 66 by using a motor and a cam or by any other known method as long as the moving device 67 is capable of moving the pressing member 66. While the sixth exemplary embodiment concerns a case where the movable roller 51 is provided on the upstream side and the pressing member 66 is provided on the downstream side in the direction of transport of the continuous paper R, the present invention is not limited to such a case. There is no problem with changing the positions of the movable roller 51 and the pressing member 66 with each other. Moreover, for example, a fixed roller may be provided between the movable roller 51 and the pressing member 66. Alternatively, fixed rollers may be provided between the movable roller 51 and the transfer position TP and between the pressing member 66 and the fixing position FP, respectively.

In such a configuration, if the degree of stretching of the continuous paper R between the transfer position TP and the fixing position FP has changed, the change in the position of the movable roller 51 is first detected by the sensor 56. Then, the tension adjusting device 60 controls the moving device 67 in accordance with the detected information and moves the pressing member 66 such that the movable roller 51 returns to the initial position.

Figure 13A:
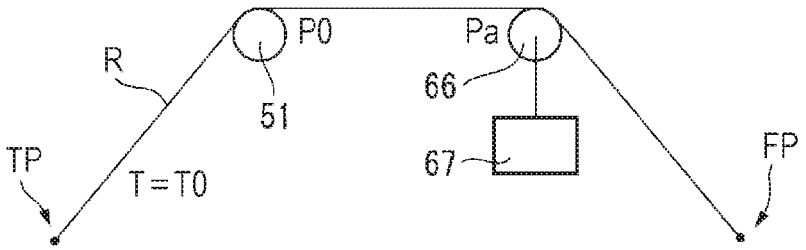
FIGS. 13A to 13C illustrate how a movable roller and a pressing member according to the sixth exemplary embodiment move.
Figure 13B:
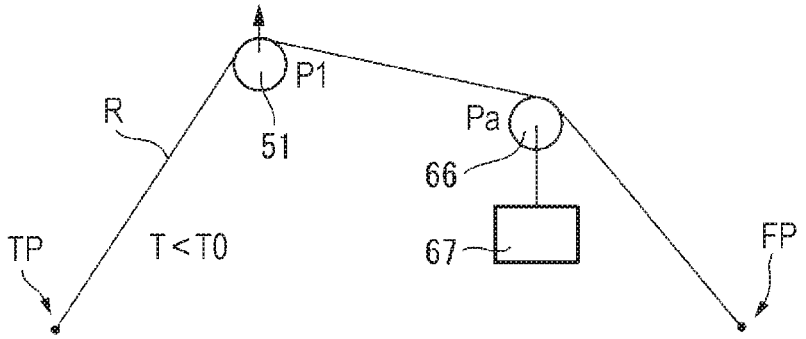
Figure 13C:
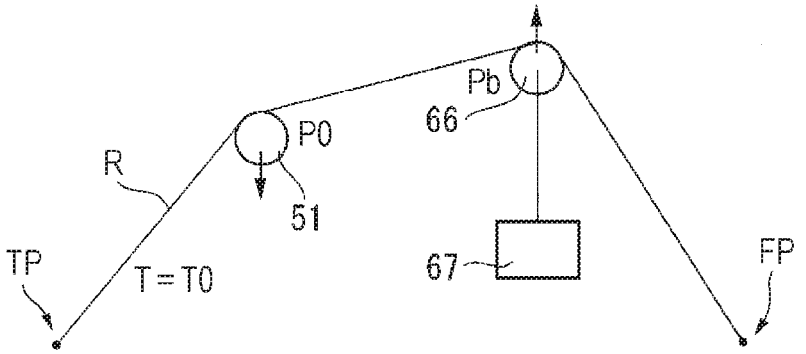

FIGS. 13A to 13C illustrate how the movable roller 51 and the pressing member 66 according to the sixth exemplary embodiment move. FIG. 13A illustrates the normal state (a state where the movable roller 51 is at an initial position P0). FIG. 13B illustrates a state where the length of the continuous paper R between the transfer position TP and the fixing position FP is longer than normal, that is, a state where the tension T is reduced. FIG. 13C illustrates a state where the pressing member 66 has been moved from the position illustrated in FIG. 13B, and the tension T of the continuous paper R between the transfer position TP and the fixing position FP has returned to the normal level.

Referring to FIG. 13A, when the continuous paper R between the transfer position TP and the fixing position FP is in the normal state, the tension T of the continuous paper R is T0, with the movable roller 51 being at the initial position P0 and the pressing member 66 being at an initial position Pa.

For example, suppose that the continuous paper R between the transfer position TP and the fixing position FP is loosened. In such a case, as illustrated in FIG. 13B, the tension T of the continuous paper R becomes lower than T0. Accordingly, the movable roller 51 moves in such a direction as to stretch the continuous paper R. Specifically, the movable roller 51 moves to a position P1. Consequently, the tension T of the continuous paper R becomes close to T0.

Then, the sensor 56 (not illustrated in FIGS. 13A to 13C) detects the above change in the position of the movable roller 51, whereby the moving device 67 is activated to move the pressing member 66 in such a direction as to stretch the continuous paper R. Thus, the tension T of the continuous paper R is increased with the movement of the pressing member 66. Therefore, the movable roller 51 gradually moves toward the initial position P0. Eventually, as illustrated in FIG. 13C, the movable roller 51 returns to the initial position P0, and the pressing member 66 moves to a position Pb.

On the contrary, suppose that the continuous paper R between the transfer position TP and the fixing position FP is stretched and the length thereof becomes shorter. The movable roller 51 is moved in such a direction as to loosen the continuous paper R. In such a case, the pressing member 66 is moved in such a direction as to further loosen the continuous paper R. Accordingly, the movable roller 51 moves close to the initial position P0, i.e., the normal position. Eventually, the movable roller 51 returns to the initial position P0, and the tension T of the continuous paper R returns to T0, of course. Needless to say, if, for example, the movable roller 51 is moved from the position illustrated in FIG. 13C toward the position P1, the pressing member 66 only needs to be further moved from the position Pb.

Employing the above pressing member 66 keeps the tension T of the continuous paper R between the transfer position TP and the fixing position FP at a constant level. Therefore, the occurrence of image defects, damage to the continuous paper R, wrinkles in the continuous paper R, and the like is suppressed.

According to the sixth exemplary embodiment, unlike the case of the first exemplary embodiment, the change in the tension of the continuous paper R is adjusted to fall within the permissible range by moving the pressing member 66 in conjunction with the movement of the movable roller 51 without adjusting the recording-material-transporting speed in the fixing device 41. While the sixth exemplary embodiment concerns a case where the movable roller 51 and the pressing member 66 are each of a roller type, the present invention is not limited to such a case. For example, at least one of the movable roller 51 and the pressing member 66 may be the plate-like member 57 (see FIG. 7) employed in the second exemplary embodiment.

While the sixth exemplary embodiment concerns a case where the pressing member 66 is moved from, for example, the initial position Pa to the position Pb, the pressing member 66 may be stoppable at plural positions between the initial position Pa and the position Pb by providing, for example, a rack-and-pinion mechanism as the moving device 67. While the sixth exemplary embodiment concerns a case where the tension T of the continuous paper R between the transfer position TP and the fixing position FP is maintained by using the pressing member 66, the recording-material-transporting speed in the fixing device 41 may also be adjusted as in the first exemplary embodiment, in addition to performing the above method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a supplying unit configured to supply a continuous recording material;

an image forming unit configured to form an image on the recording material supplied from the supplying unit;

a fixing unit configured to fix the image formed on the recording material by the image forming unit;

a collecting unit configured to collect the recording material having passed through the fixing unit;

a detecting device configured to detect a change in tension of the recording material running between the image forming unit and the fixing unit;

a tension adjusting device configured to adjust the tension acting on the recording material such that the change in the tension of the recording material falls within a permissible range if the change in the tension of the recording material that is detected by the detecting device exceeds the predetermined permissible range; and a torque limiting member configured to prevent a torque acting on the fixing unit from exceeding an upper limit, wherein the tension adjusting device adjusts the recording-material-transporting speed in at least the fixing unit unless the torque limiting member is activated, and the tension adjusting device adjusts the recording-material-transporting speed in the collecting unit if the torque limiting member is activated.

2. The image forming apparatus according to claim 1, wherein the detecting device includes a shiftable member provided in contact with a non-image surface of the recording material running between the image forming unit and the fixing unit, the shiftable member being shiftable in a direction intersecting a plane of the recording material; and a position detector configured to detect a change in the position of the shiftable member.

3. The image forming apparatus according to claim 1, wherein the detecting device includes a stretching member provided in contact with a non-image surface of the recording material running between the image forming unit and the fixing unit, the stretching member being configured to stretch the recording material; and a load detector configured to detect a change in a load acting on the stretching member.

4. The image forming apparatus according to claim 1, wherein the tension adjusting device adjusts a recording-material-transporting speed in at least one of the fixing unit and the collecting unit.

5. The image forming apparatus according to claim 2, wherein the tension adjusting device adjusts a recording-material-transporting speed in at least one of the fixing unit and the collecting unit.

6. The image forming apparatus according to claim 3, wherein the tension adjusting device adjusts a recording-material-transporting speed in at least one of the fixing unit and the collecting unit.

7. The image forming apparatus according to claim 1, wherein the fixing unit fixes the image while being out of contact with the recording material, and wherein the tension adjusting device adjusts the recording-material-transporting speed in the collecting unit.

8. The image forming apparatus according to claim 2, wherein the fixing unit fixes the image while being out of contact with the recording material, and wherein the tension adjusting device adjusts the recording-material-transporting speed in the collecting unit.

9. The image forming apparatus according to claim 3, wherein the fixing unit fixes the image while being out of contact with the recording material, and wherein the tension adjusting device adjusts the recording-material-transporting speed in the collecting unit.

10. The image forming apparatus according to claim 1, wherein the detecting device includes a shiftable member provided in contact with a non-image surface of the recording material running between the image forming unit and the fixing unit, the shiftable member being shiftable in a direction intersecting a plane of the recording material; and a position detector configured to detect a change in the position of the shiftable member, wherein the tension adjusting device includes a pressing member that presses the recording material at a position on a non-image surface of the recording material running between the image forming unit and the fixing unit, the position being different from the position of the shiftable member, the pressing member being movable in a direction intersecting a plane of the recording material, and wherein the tension adjusting device moves the pressing member such that the change in tension of the recording material falls within the permissible range.

* * * * *